US011692366B1

(12) United States Patent
Wood

(10) Patent No.: US 11,692,366 B1
(45) Date of Patent: Jul. 4, 2023

(54) MODULAR REMOVABLE COVERING AND BARRIER SYSTEM

(71) Applicant: Steven M. Wood, Tulsa, OK (US)

(72) Inventor: Steven M. Wood, Tulsa, OK (US)

( * ) Notice: Subject to any disclaimer, the term of this patent is extended or adjusted under 35 U.S.C. 154(b) by 23 days.

(21) Appl. No.: 17/485,707

(22) Filed: Sep. 27, 2021

Related U.S. Application Data

(60) Provisional application No. 63/085,423, filed on Sep. 30, 2020.

(51) Int. Cl.
*E04H 4/10* (2006.01)

(52) U.S. Cl.
CPC ..... *E04H 4/108* (2013.01); *E04H 4/105* (2013.01)

(58) Field of Classification Search
CPC ..... E04H 4/108
USPC ..... 4/498, 496–496; 135/87; 220/216; 126/171.1
See application file for complete search history.

(56) References Cited

U.S. PATENT DOCUMENTS 3,093,834 A * 6/1963 Watkins ..... E04H 3/165 D25/56
4,459,711 A * 7/1984 Sartain ..... E04H 4/101 4/502
4,464,801 A * 8/1984 Lamb ..... E04H 4/101 4/502
4,466,143 A * 8/1984 Lamb ..... E04H 4/101 4/502
4,967,424 A * 11/1990 Stegmeier ..... E04H 4/142 4/496
5,259,078 A * 11/1993 Crandall ..... E04H 4/10 4/503
5,546,972 A * 8/1996 Wardell ..... B60J 7/062 296/105
5,913,613 A * 6/1999 Ragsdale ..... E04H 4/101 4/502
5,920,922 A * 7/1999 Ragsdale ..... E04H 4/101 4/502
6,000,071 A * 12/1999 Fettes ..... E04H 4/084 49/386
6,526,604 B1 * 3/2003 Mathis ..... E04H 4/101 4/502
6,862,756 B2 * 3/2005 Mathis ..... E04H 4/101 4/502
7,861,471 B2 * 1/2011 Smith ..... E04H 4/148 4/498
8,261,378 B2 * 9/2012 Kanetis ..... E04H 4/084 4/500
2002/0144340 A1 * 10/2002 Last ..... E04H 4/101 4/502
2004/0055081 A1 * 3/2004 Wilson ..... E04H 4/084 4/498

(Continued)

*Primary Examiner* — Lori L Baker
(74) *Attorney, Agent, or Firm* — Head, Johnson, Kachigian & Wilkinson, PC

(57) ABSTRACT

A modular removable covering and barrier system. In one embodiment, a removable pool or pond covering system includes a track assembly installed on a deck along the perimeter of a pool, a sheet of plastic or other suitable material spanning the area enclosed by the track assembly, a bottom seal between the track assembly and the deck, and a top seal between the track system and the sheet of plastic. The track assembly may be modular such that the track assembly can be installed on any size and shape of pool or pond and can be easily stored when not in use.

20 Claims, 13 Drawing Sheets

(56) References Cited

U.S. PATENT DOCUMENTS

| | | | | |
|---|---|---|---|---|
| 2005/0028264 | A1* | 2/2005 | Smith | E04H 4/101<br>4/502 |
| 2005/0108817 | A1* | 5/2005 | Wilson | E04H 4/108<br>4/498 |
| 2011/0061158 | A1* | 3/2011 | Smith | E04H 4/148<br>29/428 |
| 2021/0102392 | A1* | 4/2021 | Peterson | E04H 4/108 |

* cited by examiner

MODULAR REMOVABLE COVERING AND BARRIER SYSTEM

CROSS-REFERENCE

This application is based on and claims priority to U.S. Provisional Patent Application No. 63/085,423 filed Sep. 30, 2020.

BACKGROUND OF THE INVENTION

1. Field of the Invention

This invention relates generally, but not by way of limitation, to a removable covering and barrier system and, in one embodiment, to a modular system for removably covering a swimming pool or pond.

2. Description of the Related Art

Whether used for recreation or exercise, swimming pools are commonplace around the world. Pools are often located in homeowners' backyards, at gyms, in community centers, or in neighborhoods. Due to their large footprint, swimming pools are generally located outdoors. Since swimming is ideally done in water that is a comfortable temperature, outdoor pools become unusable during winter months in many places.

Consequently, it has become a common practice to cover outdoor pools while they are not being used in the winter. One advantage of this is to keep falling leaves and blowing debris from getting stuck in and fouling the quality of the water. Similarly, a pool cover prevents insects and wild animals from entering the water for purposes of drinking, feeding, or breeding. An additional advantage is that effective pool covers keep precipitation such as rain, sleet, or snow from increasing a pool's water level or affecting the pH balance of the pool water.

Likewise, decorative ponds are sometimes covered when not in use.

Many different attempts have been made to design a system that covers pools or ponds during nonuse. One design for a pool cover is comprised of a tarpaulin cover tied down to bolts placed along the perimeter of the pool. An improvement on this method comprises supporting the center of the tarpaulin at an elevation higher than the edge of the pool or pond such that rain and other precipitation will run off the cover rather than collecting in the center of the cover. This method, however, is not foolproof and over time water can begin to collect on the tarpaulin.

Alternatively, another prior design attempts to better seal the edge of the cover by fixing tracks on a deck along the perimeter of the pool. The tracks are designed to receive the entire perimeter of the pool cover such that all portions of the perimeter of the pool cover are firmly affixed to the edge of the pool. This design is to intended reduce the openings through which insects, water runoff, or other pollutants can enter the pool while covered. However, this prior design still suffers from the potential for water to collect on top of the pool cover, making removal of the cover difficult for the user or, worse, collapses contents into the pool. In addition, the cover must be custom manufactured to connect with the tracks.

Based on the foregoing, it is desirable to provide a pool or pond cover that eliminates gaps between the pool or pond cover and the deck of the pool or pond such that the seal therebetween is both airtight and watertight and blocks sunlight.

It is further desirable to provide a pool or pond cover system to aid rain and other precipitation in running off and not collecting on top of the pool or pond cover.

It is even further desirable for the pool or pond cover to be modular such that the system can be installed on any size and shape of pool or pond and easily stored when not in use.

SUMMARY OF THE INVENTION

The present invention relates to a modular removable covering and barrier system. In one embodiment, the invention relates to a modular pool or pond covering system having: a track assembly affixed to a deck along an entire perimeter of a pool; at least one resilient bottom seal located between the track and the deck; an opening along a top side of the track into a cavity in the top portion of the track such that the opening is narrower than the cavity and both span the length of the track; a sheet of flexible impervious material spanning an area enclosed by the track assembly; and a top seal where, when the pool cover is fully assembled, the sheet and at least a portion of the top seal strip are inserted into the cavity creating a seal between the sheet and the track.

The track assembly may be modular such that a plurality of elongate track segments, each with two opposing distal ends, can be installed to span the entire perimeter of the pool. The plurality of track segments may be joined together by a plurality of joinder brackets affixed to an inner surface of the distal ends of the track segments.

The track assembly may be affixed to the deck around a perimeter of a pool with fasteners.

The top seal may comprise a relatively flat portion and a protuberant portion where, when the pool cover is fully assembled, the protuberant portion is located inside of the cavity and held inside by the narrow opening such that the attached flat portion of the top seal strip rests squarely on both outer surfaces of the narrow opening to create a seal. Further, when the pool cover is fully assembled, the perimeter of the sheet is clasped between the top seal and the track assembly.

The space between the pool cover and the surface of the pool may be airtight and inflated to elevate the center of the pool cover.

Other advantages and features will be apparent from the following description and from the claims.

DETAILED DESCRIPTION OF THE INVENTION

The embodiments discussed herein are merely illustrative of specific manners in which to make and use the invention and are not to be interpreted as limiting the scope.

While the invention has been described with a certain degree of particularity, it is to be noted that many modifications may be made in the details of the invention's construction and the arrangement of its components without departing from the scope of this disclosure. It is understood that the invention is not limited to the embodiments set forth herein for purposes of exemplification.

Figure 1:
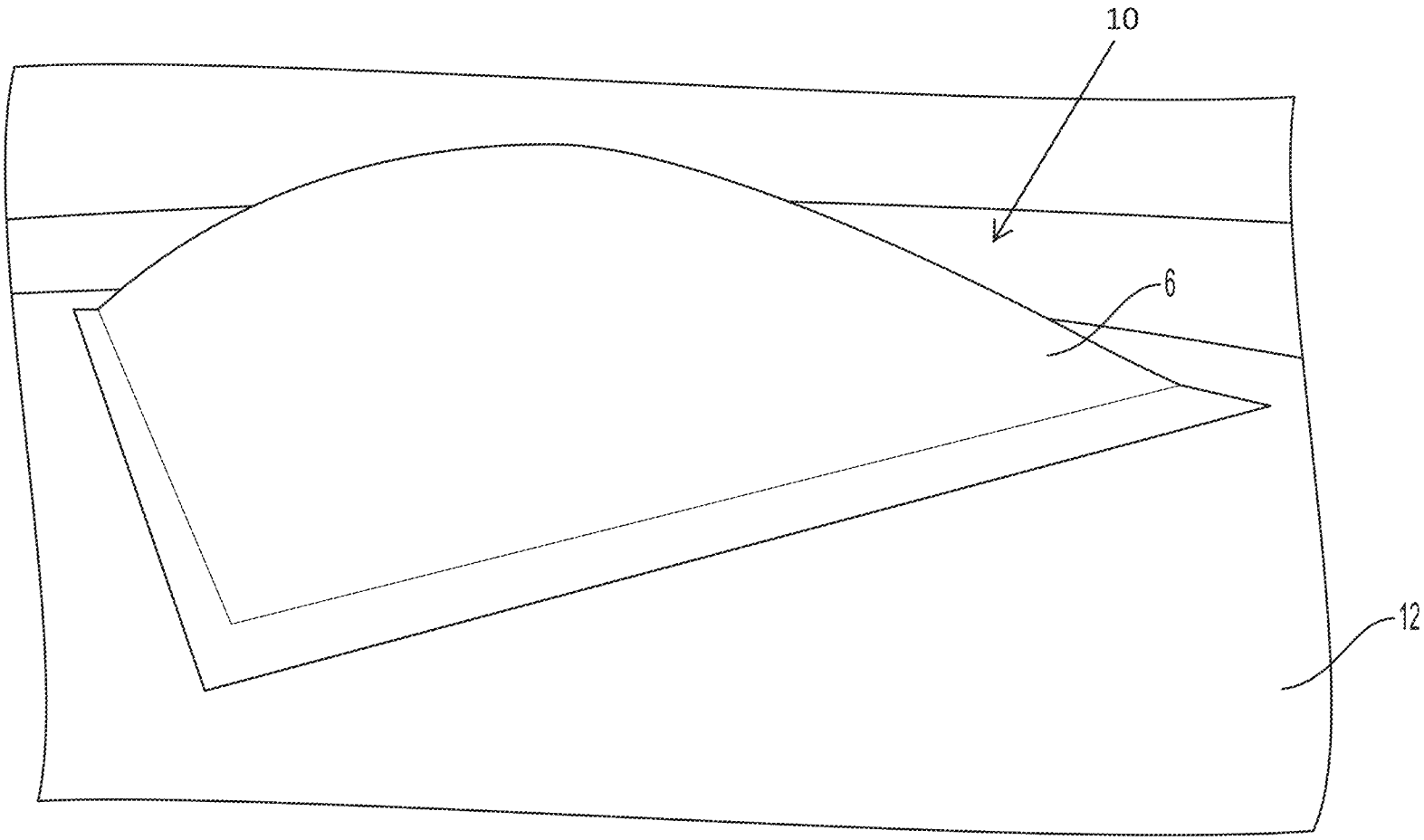
FIG. 1 is a perspective view of one embodiment of a fully assembled modular pool and pond covering system installed on a pool in accordance with the present invention.
Figure 2:
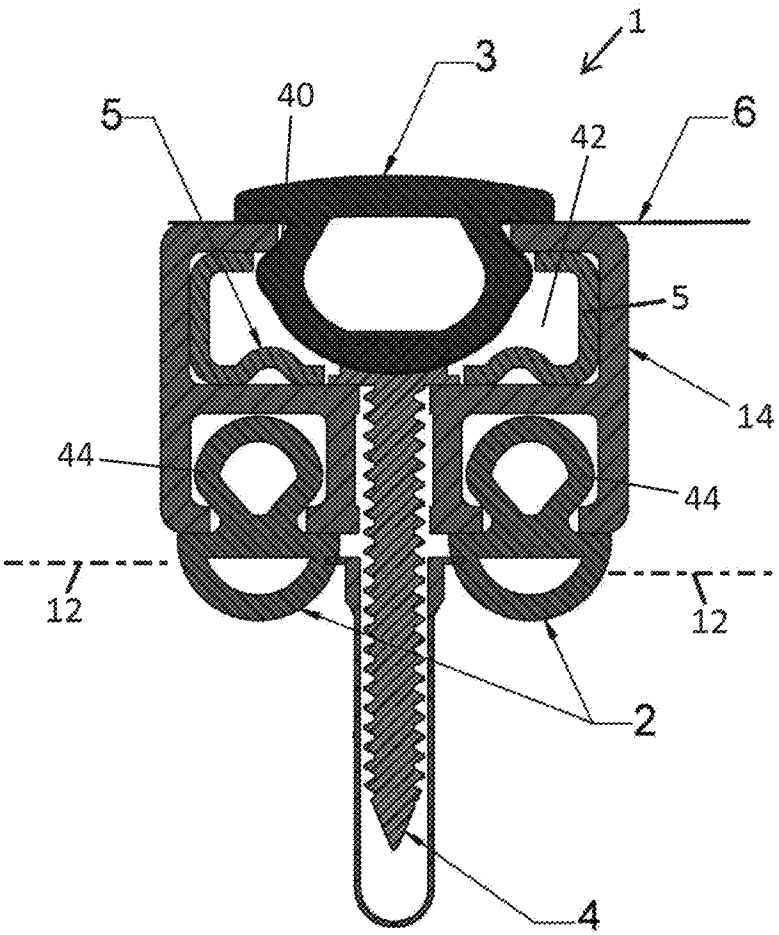
FIG. 2 is a cross-sectional view of a portion of one embodiment of the fully assembled system shown in FIG. 1.
Figure 3:
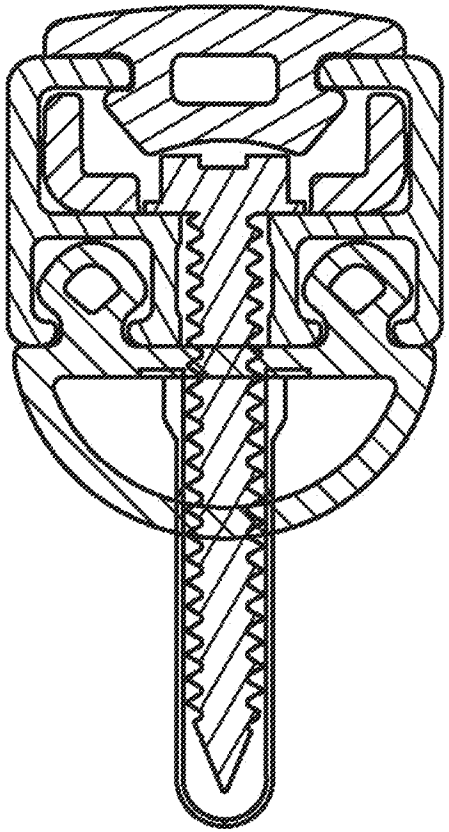
FIG. 3 is a cross-sectional view of a portion of a second embodiment of the fully assembled system shown in FIG. 1.

Referring to the drawings in detail, the present invention relates to a modular removable covering and barrier system. In one embodiment, the invention relates to a modular removable pool covering system 10, a portion of which is seen in FIG. 1. The system 10 includes a track assembly 1 affixed to a deck 12 along an entire perimeter of a pool. FIG. 2 illustrates a sectional view of the track assembly 1. As best seen in the sectional view in FIG. 2, the track assembly 1 may have an elongated opening 40 along a top side of the track assembly into a channel cavity 42 in the top portion of the track assembly such that the opening is narrower than the channel cavity and both span the length of the track. The track assembly 1 may be affixed to the deck of the pool by fasteners 4, such as screws, or any other suitable manner of attachment.

Figure 4:
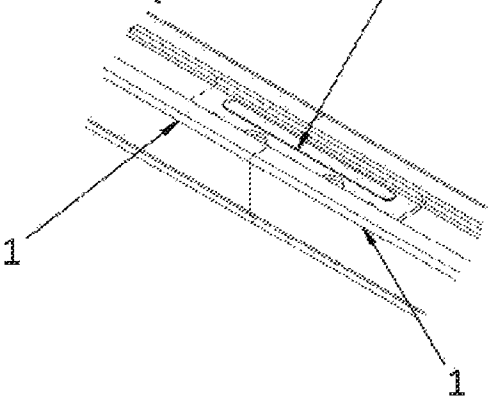
FIG. 4 is a perspective view of two track segments joined together by a joinder bracket.

The track assembly 1 may be modular such that a plurality of track segments 14 with two opposing distal ends span the entire perimeter of a pool by joining the distal ends together. The track segments 14 may be joined at their ends by joinder brackets 5 inserted into and across the channel cavity of the segments 14 joined together. The joinder brackets 5 may be linear or straight such that the two joined track segments are aligned as shown in FIG. 4 or the joinder brackets 5 may be angled such that the two joined track segments meet at a desired angle as shown in FIG. 5.

Figure 5:
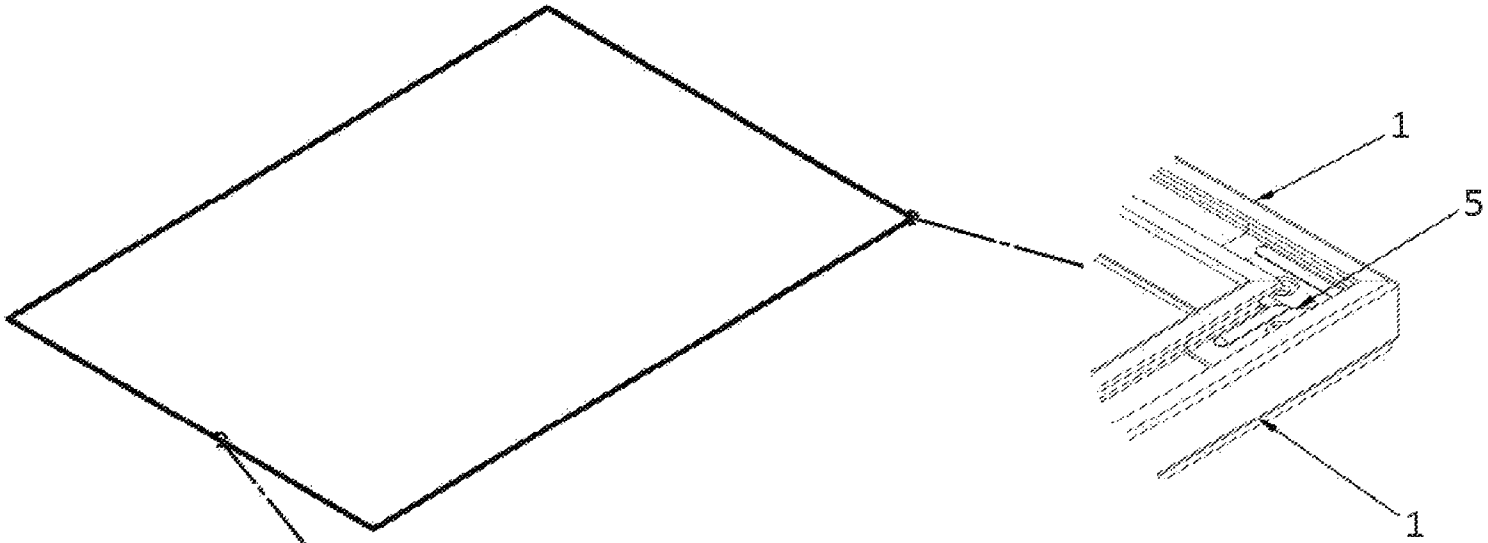
FIG. 5 is a perspective view of two track segments joined together by a joinder bracket at a corner of the perimeter.
Figure 6:
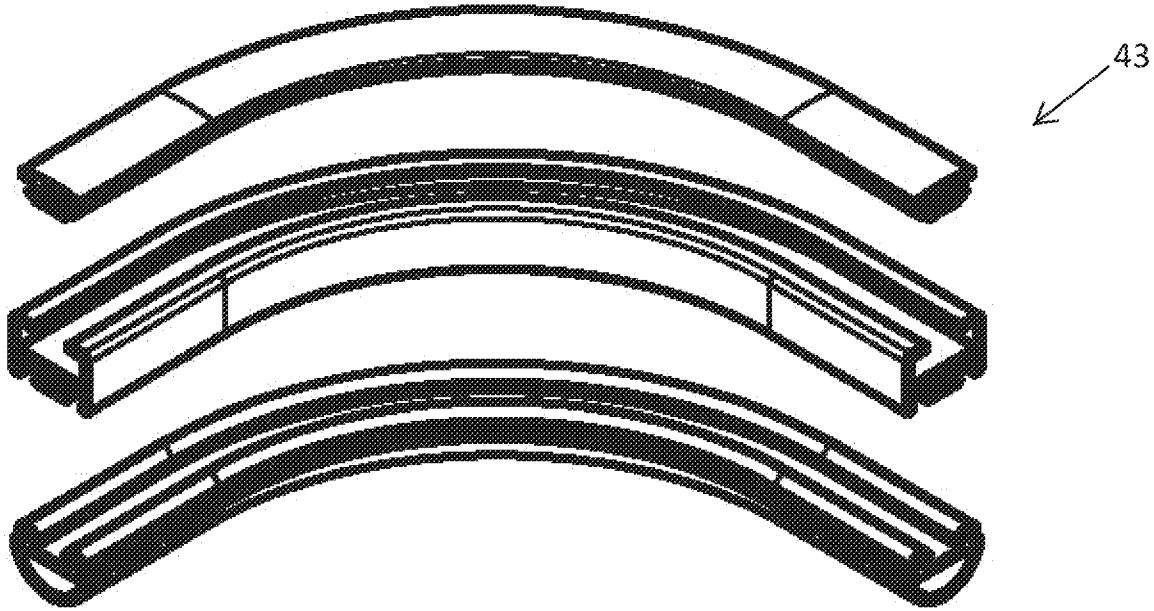
FIG. 6 is an exploded, perspective view of a curved track segment with a bottom seal and a top seal.

The joinder bracket 5 in FIG. 5 is at a 90-degree angle although other angles are possible. Alternatively, the track pieces may be curved, as seen in the exploded view in FIG. 6, Reference No. 43, to serve as a corner piece while still using straight joinder pieces on either end.

Providing for the track segments to join either aligned or at an angle allows for the system to be expandable and to contour to any size and shape of pool or pond. Further, modular track segments allow for easy transportation or storage when the pool covering system is not in use.

Figure 7:
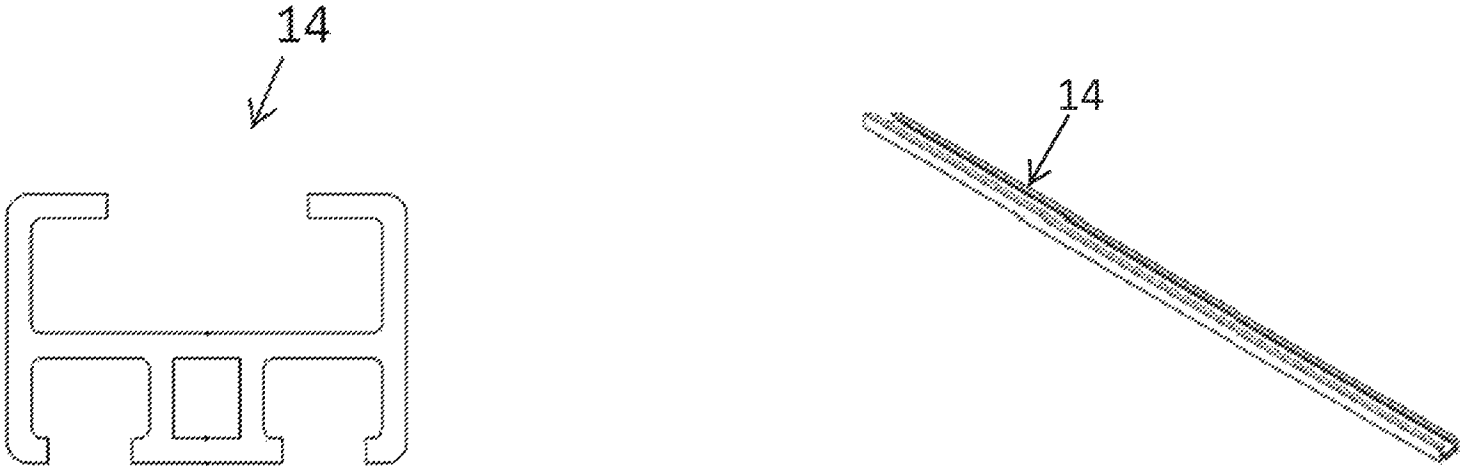
FIG. 7 is an end and a perspective view of the track.

FIG. 7 illustrates a single track segment 14 apart from the system 10.

The modular pool covering system 10 further includes at least one bottom seal 2 extending from the track assembly 1 located between the track assembly 1 and the deck 12 around the entire perimeter of the pool. One embodiment of the bottom seal 2 may comprise a pair of parallel seal strips that span lengthwise along a bottom side of the track assembly such that the two seal strips are located on either side of the fasteners 4 as shown in FIG. 2.

Figure 11:
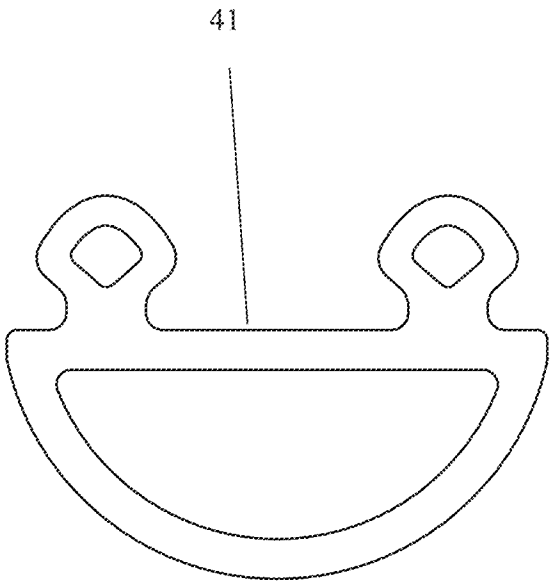
FIG. 11 is an end view of a second embodiment of a bottom seal apart from the system.
Figure 12:
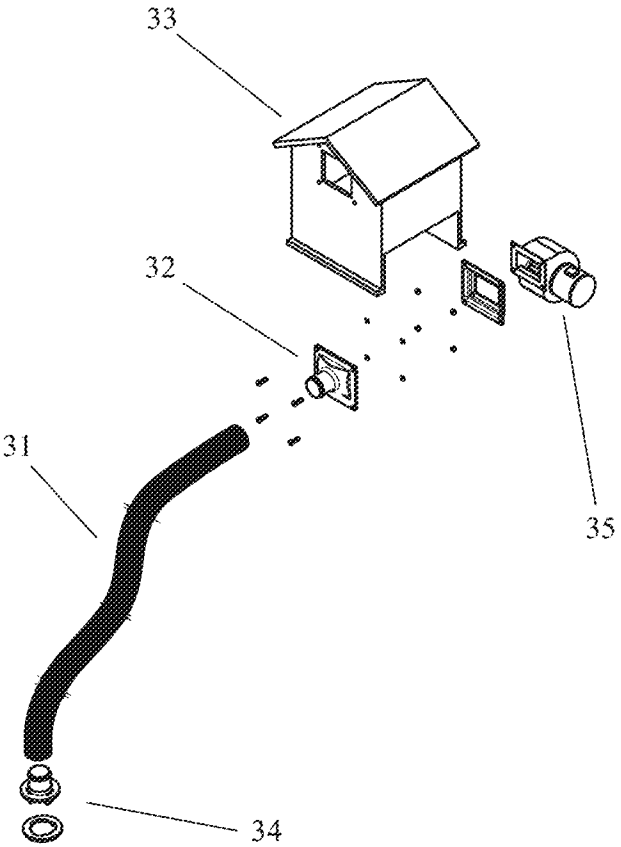
FIG. 12 is an exploded view of a first embodiment of a blower system.

Another alternate embodiment of the bottom seal 41, as shown in FIG. 11, may comprise one single seal strip that spans the width of the bottom of the track and attaches to the track on both sides similar to the first embodiment.

Yet another embodiment of the bottom seal, may have two separate bottom seal strips each with flaps that protrude towards the other strip, but are not connected to each other.

Returning to a consideration of FIG. 2, the modular pool covering system 10 may further comprise a top seal 3 and a flexible sheet 6, such as plastic or other suitable material. The flexible sheet 6 may span the area enclosed by the track assembly 1 such that the sheet covers the entire surface of the pool as shown in FIG. 1.

Figure 8:
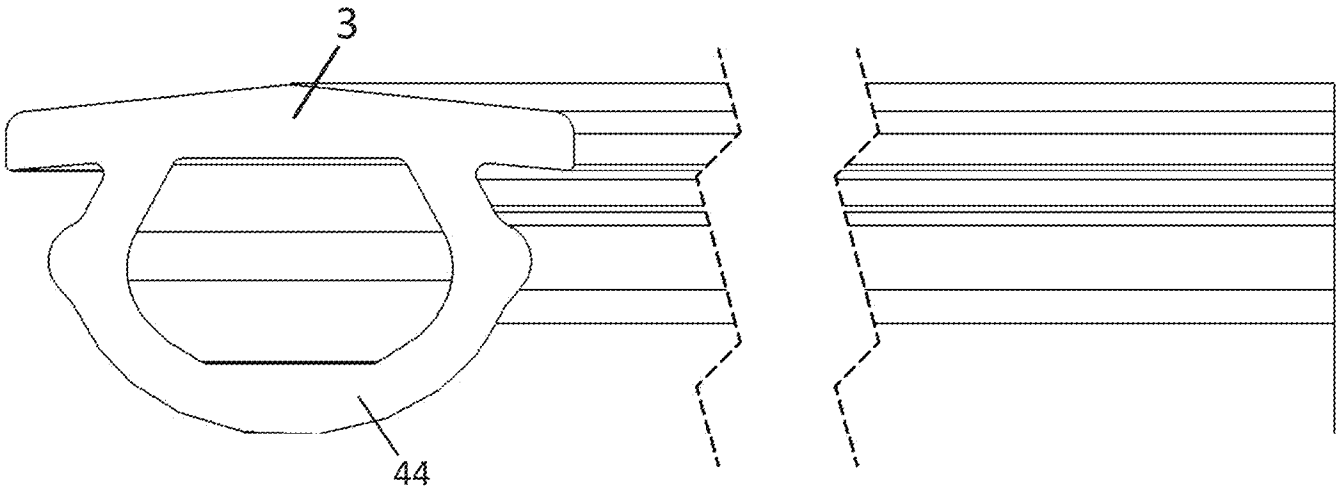
FIG. 8 is a perspective view of the first embodiment of a top seal apart from the system.
Figure 9:
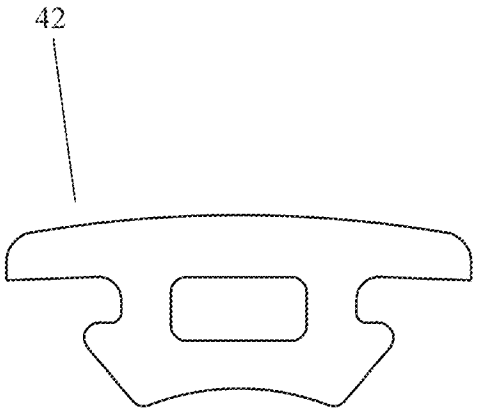
FIG. 9 is an end view of a second embodiment of the top seal apart from the system.
Figure 10:
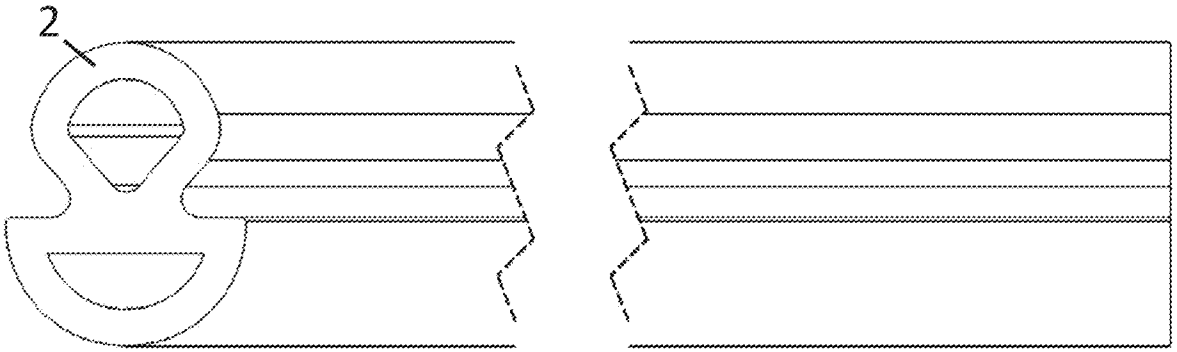
FIG. 10 is a perspective view of a first embodiment of a bottom seal apart from the system.

As best seen in FIG. 8, the top seal 3 may consist of a relatively upper flat portion and an opposed enlarged protuberant portion. When the pool covering system 10 is fully assembled, the protuberant portion of the top seal 3 is received in the channel cavity and held inside by the narrow opening such that the upper flat portion of the top seal strip rests squarely on both outer surfaces of the narrow opening to create a seal as shown in FIG. 2. A second alternate embodiment of the top seal 42 is shown in FIG. 9.

Further, when fully assembled, the flexible sheet 6 may be located between and clasped by the top seal 3 and the track assembly 1. Accordingly, the flexible sheet is trapped between the top seal and the track assembly. Consequently, the bottom seal 2 creates an airtight seal between the track assembly 1 and the deck 12 along the entire perimeter of the pool. The top seal 3 creates an airtight seal between the flexible sheet 6 and the track assembly 1 thereby making the space enclosed by the pool covering system airtight. This eliminates the ability of insects, small animals to enter the water, and prevents water runoff from entering the pool while covered.

The flexible sheet 6 may be a single color or different colors on either side. For example, it may be black on one side and white on the other side. This allows for temperature regulation by the user based on light reflection and absorption. Since the flexible sheet is easily secured and removed, it may be changed as desired.

Finally, the space enclosed by the pool covering system may be inflated in order to elevate the center of the sheet as shown in FIG. 1 by a fan. This allows for rainwater and other precipitation to run off of the pool cover instead of collecting on top of the cover.

Figure 13:
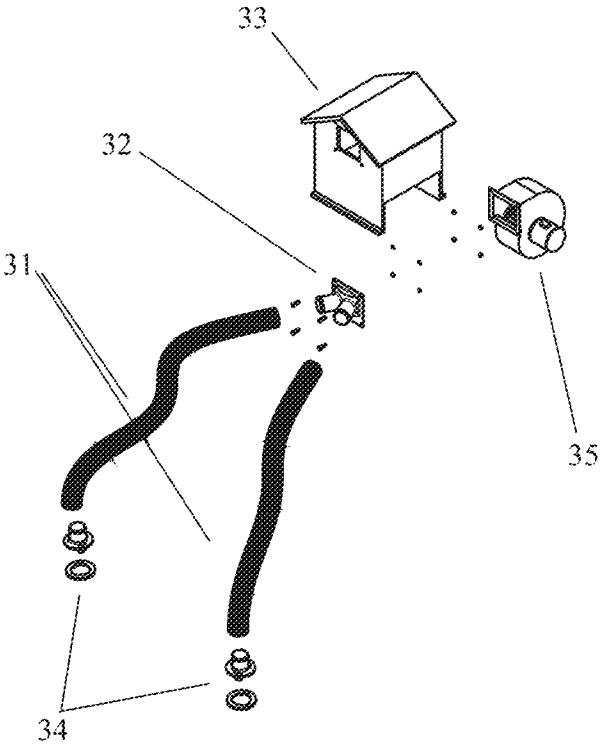
FIG. 13 is an exploded view of a second embodiment of a blower system.

The blower mechanism may comprise a blower or fan 35, a blower housing 33, an output nozzle 32, one or more hoses 31, and adapters 34 that allow for the hoses to be removably attached to the flexible sheet. If the particular application of a cover requires, the output nozzle may split airflow from a single blower to two or more hoses as shown in FIG. 13. The adapter 34 may be a twist lock mechanism that each side of the adapter clamps on either side of the cover.

The entire system may be assembled from these modular components and then disassembled and stored when not in use.

Figure 14:
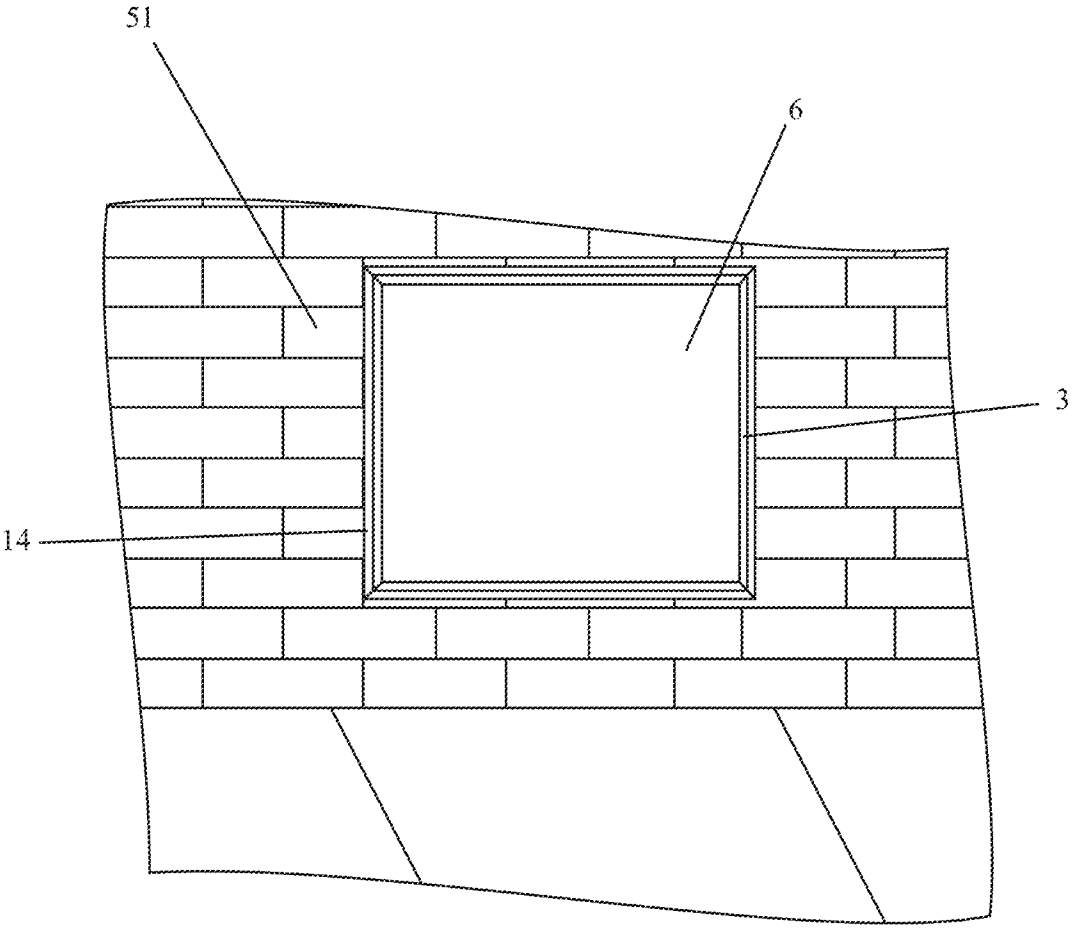
FIG. 14 is a top view of one embodiment of a fully assembled barrier system installed over an opening in a wall in accordance with the present invention.

While the embodiments shown are a cover for a pool or pond, the system can be used as a part of any kind of barrier, wall 51, or enclosure system. For example, the track system may retain a flexible sheet that together form a portable wall, as shown in FIG. 14, or ceiling of a building or structure.

The flexible cover could easily be replaced with a screen or translucent or transparent material to further increase the versatility of this system.

Whereas, the invention has been described in relation to the drawings attached hereto, it should be understood that other and further modifications, apart from those shown or suggested herein, may be made within the scope of this invention.

What is claimed is:

1. A removable pool or pond covering system having a deck around a perimeter of said pool or pond, which system comprises:

a track assembly surrounding the perimeter of a pool or pond, said track assembly having a base and an opposed top side;

at least one resilient bottom seal extending from said base of said track assembly, said at least one bottom seal engaging a deck around said perimeter;

an opening having an enlarged channel cavity along said top side of the track assembly such that the opening is narrower than the channel cavity and both span a length of the track assembly;

a sheet of flexible material spanning an area enclosed by the track assembly and overlaying and received in said opening having an enlarged channel cavity; and a resilient top seal, at least a portion receivable into said opening and said enlarged channel cavity, said top seal inserted into the channel cavity, retaining said flexible sheet and creating a seal between the flexible sheet and the track assembly.

2. The pool or pond covering system of claim 1 where the track assembly is modular having a plurality of elongated track segments, each with two opposing distal ends connectable to span the entire perimeter.

3. The pool or pond covering system of claim 2 where the plurality of track segments are joined together at their distal ends by a plurality of joinder brackets affixed to the distal ends at an inner surface of the channel cavity.

4. The pool or pond covering system of claim 1 where the track assembly is affixed to the perimeter of the deck with fasteners.

5. The pool or pond covering system of claim 4 wherein said fasteners include a plurality of anchors in said deck and a plurality of screws passing through openings in said plurality of track segments, said screws receivable in said anchors.

6. The pool or pond covering system of claim 1 wherein said at least one bottom seal comprises two parallel seal strips that span said base of the track assembly.

7. The pool or pond covering system of claim 6 wherein each of said seal strips includes a compressible protuberant portion received in a channel in said base of said track assembly.

8. The pool or pond covering system of claim 1 wherein said at least one bottom seal comprises one seal strip as wide as the track that spans said base of the track assembly.

9. The pool or pond covering system of claim 1 wherein said top seal comprises a relatively flat portion and an opposed compressible protuberant portion.

10. The pool or pond covering system of claim 9 wherein said compressible protuberant portion is received inside of the cavity and held inside by the opening such that the flat portion of the top seal strip rests squarely on both outer surfaces of the narrow opening to create a seal.

11. The pool or pond covering system of claim 1 wherein a space between the flexible sheet and the surface of the pool or pond is airtight.

12. The pool or pond covering system of claim 11 wherein the space between the flexible sheet and the surface of the pool is inflated.

13. The pool or pond covering system of claim 12 wherein a fan or blower inflates the space through at least one tube connected to the flexible sheet.

14. The pool or pond covering system of claim 13 wherein a connection of the hose to the cover further comprises at least one twist lock hose connector.

15. The pool or pond covering system of claim 2 wherein said plurality of elongated track segments include linear segments.

16. The pool or pond covering system of claim 2 wherein said plurality of elongated track segments include curved segments.

17. The pool or pond covering system of claim 2 wherein said plurality of elongated track segments include angled segments.

18. The pool or pond covering system of claim 1 wherein said sheet of flexible material is opaque.

19. The pool or pond covering system of claim 1 wherein said sheet of flexible material is black in color on a first side and white in color on a second side.

20. A removable covering or barrier system for enclosing an open area, which system comprises:

a track assembly surrounding a perimeter of said open area, said track assembly having a base and an opposed top side;

at least one resilient bottom seal extending from said base of said track assembly, said at least one bottom seal engaging a surface around said perimeter;

an opening having an enlarged channel cavity along said top side of the track assembly such that the opening is narrower than the channel cavity and both span a length of the track assembly;

a sheet of flexible material spanning an area enclosed by the track assembly and overlaying and received in said opening having an enlarged channel cavity; and a resilient top seal, at least a portion receivable into said opening and said enlarged channel cavity, said top seal inserted into the channel cavity, retaining said flexible sheet and creating a seal between the flexible sheet and the track assembly.

* * * * *